United States Patent [19]

Nilssen

[11] Patent Number: 4,888,525

[45] Date of Patent: Dec. 19, 1989

[54] SUN TANNING APPARATUS HAVING ELECTRONIC OPERATING SYSTEM

[76] Inventor: Ole K. Nilssen, Caesar Dr., Rte. 5, Barrington, Ill. 60010

[21] Appl. No.: 735,162

[22] Filed: May 17, 1985

[51] Int. Cl.[4] ..... H05B 41/36

[52] U.S. Cl. ..... 315/212; 315/210; 315/224; 315/DIG. 7; 363/172

[58] Field of Search ..... 315/209 R, 219; 331/113 A; 338/20; 363/50, 172, 159; 250/504 R

[56] References Cited

U.S. PATENT DOCUMENTS

| | | | |
|---|---|---|---|
| 4,029,993 | 6/1977 | Alley et al. | 315/209 R |
| 4,045,711 | 8/1977 | Pitel | 315/209 R |
| 4,053,813 | 10/1977 | Kornrumpf et al. | 315/209 R |
| 4,070,570 | 1/1978 | Wetmore et al. | 313/490 |
| 4,184,128 | 1/1980 | Nilssen | 331/113 A |
| 4,188,661 | 2/1980 | Bower et al. | 331/113 A |
| 4,196,354 | 4/1980 | Wolff | 250/494.1 |
| 4,214,186 | 7/1980 | Kreutzer | 315/104 |
| 4,438,372 | 3/1984 | Zuchtriegel | 315/210 |
| 4,499,403 | 2/1985 | Leppelmeier et al. | 313/487 |
| 4,506,318 | 3/1985 | Nilssen | 363/132 |
| 4,560,908 | 12/1985 | Stupp et al. | 315/219 |

*Primary Examiner*—Robert L. Griffin

*Assistant Examiner*—T. Salindong

[57] ABSTRACT

A sun tanning apparatus has an electronic operating system comprising: (i) a plurality of pairs of fluorescent lamps for providing tanning radiation, each pair of lamps being adapted to be powered from 30 kHz/120 Volt by way of a high-Q series-resonant L-C ballasting circuit; (ii) a relatively low-power frequency converter connected with the power line and operable to provide power for heating the cathodes in these fluorescent lamps, thereby conditioning the lamps for easy starting; (iii) a relatively high-power frequency converter also connected with a power line and operable to provide the 30 kHz/120 Volt required for operating the plurality of pairs of fluorescent lamps by way of the high-Q series-resonant L-C ballasting circuit; and (iv) delay means operable to prevent the 30 kHz/120 Volt provided by the high-power frequency converter from being applied to the fluorescent lamps until after power has been applied to heat the lamp cathodes for at least one second. Each high-Q series-resonant L-C ballast circuit is protected from over-voltages by a Varistor, which acts as a substitute load in case a lamp is removed or fails to operate properly. If current should flow through one of the Varistors for more than a few milliseconds, the high-power frequency converter is disabled, thereby removing the 30 kHz/120 Volt.

23 Claims, 3 Drawing Sheets

SUN TANNING APPARATUS HAVING ELECTRONIC OPERATING SYSTEM

BACKGROUND OF THE INVENTION

1 Field of Invention

The present invention relates to operating systems for sun tanning and other skin treatment apparatus, particularly of the kind using a plurality of fluorescent lamps.

2 Prior Art

An ordinary sun tanning bed or booth typically comprises between 20 and 40 fluorescent lamps, with each lamp being 72" long and requiring about 100 Watt of power input for effective operation. These lamps are powered by way of a plurality of individual ballasts, with each ballast powering one or two lamps.

The fluorescent lamps used are of the so-called rapid-start type; which implies that each lamp requires four supply wires for proper operation. As a result, the number of wires required for powering 20-to-40 fluorescent lamps gets to be very high.

SUMMARY OF THE INVENTION

Brief Description

Subject invention constitutes an operating system for a sun tanning apparatus. In its preferred embodiment, this operating system is adapted to be powered from an ordinary electric utility power line and comprises:

(a) special fluorescent lamps for providing skin tanning radiation, these lamps being arranged in the form of a plurality of separately identifiable lamp lamp-ballast assemblies, each such assembly having: (i) a pair of fluorescent lamps, (ii) a high-Q series-resonant L-C ballasting circuit operable to power the pair of lamps from 30 kHz/120 Volt, and (iii) a first and a second set of assembly terminals, one set located at each end of the assembly;

(b) a central frequency-converting power supply connected with said power line and having: (i) a relatively low-power frequency converter operable to provide a first 30 kHz/120 Volt AC voltage for heating the cathodes in these fluorescent lamps, thereby to condition the lamps for easy starting, (ii) a relatively high-power frequency converter operable to provide a second 30 kHz/120 Volt AC voltage for operating the plurality of lamp-ballast assemblies, and (iii) a first and a second set of central terminals;

(c) a first and a second distribution conductor means operable to provide connection between said first and second sets of central terminals and said first and second sets of assembly terminals; and (iv) delay means operable to prevent the second 30 kHz/120 Volt AC voltage from being applied to the lamp assemblies until after the first 30 kHz/120 Volt AC voltage has had an opportunity to heat the lamp cathodes for at least one second.

DESCRIPTION OF THE PREFERRED EMBODIMENT

Details of Construction

Figure 1:
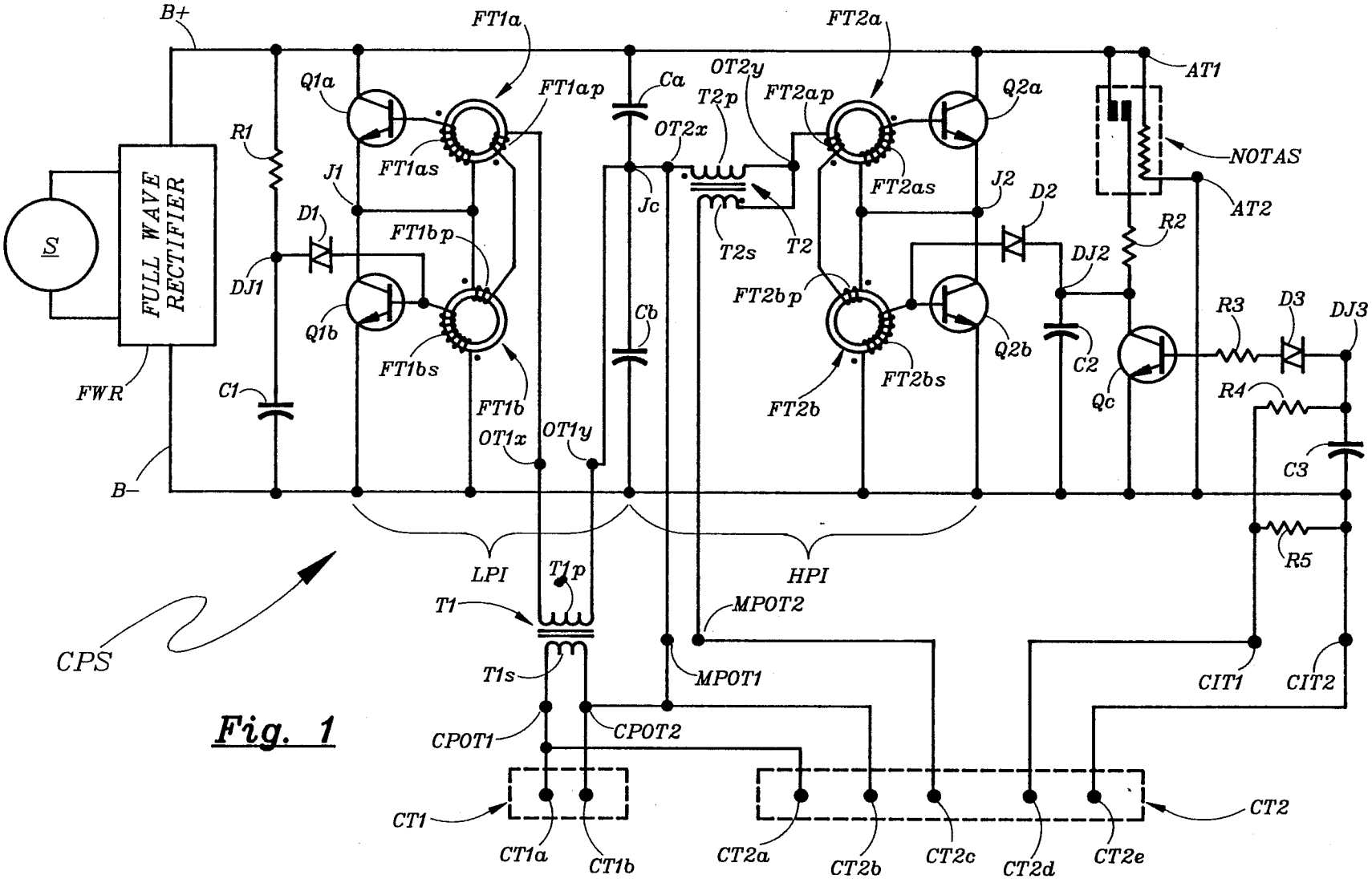
FIG. 1 provides a schematic illustration of the central frequency-converting power supply.

FIG. 1 shows an AC voltage source S, which in reality is an ordinary 120 Volt/60 Hz electric utility power line.

Connected to S is a full-wave rectifier FWR that rectifies the AC voltage from S to provide an unfiltered DC voltage between a positive power bus B+ and a negative power bus B−.

A first pair of transistors Q1*a* and Q1*b* are connected in series between the B+ bus and the B− bus in such a way that the collector of Q1*a* is connected to the B+ bus, the emitter of Q1*a* is connected with the collector of Q1*b* at a juction J1, and the emitter of Q1*b* is connected with the B− bus.

A second pair of transistors Q2*a* and Q2*b* are connected in series between the B+ bus and the B− bus in such a way that the collector of Q2*a* is connected to the B+ bus, the emitter of Q2*a* is connected with the collector of Q2*b* at a junction J2, and the emitter of Q2*b* is connected with the B− bus.

Primary winding FT1*ap* of saturable feedback transformer FT1*a* and primary winding FT1*bp* of saturable feedback transformer FT1*b* are connected in series between junction J1 and output terminal OT1*x*. Another output terminal OT1*y* is connected with junction JC between capacitors C*a* and C*b;* which capacitors are connected in series between the B+ bus and the B− bus.

Primary winding FT2*ap* of saturable feedback transformer FT2*a* and primary winding FT2*bp* of saturable feedback transformer FT2*b* are connected in series between junction J2 and output terminal OT2*y*. Another output terminal OT2*x* is connected with junction JC.

Secondary winding FT1*as* of feedback transformer FT1*a* is connected between the base and the emitter of transistor Q1*a;* and secondary winding FT1*bs* of feedback transformer FT1*b* is connected between the base and the emitter of transistor Q1*b*.

Secondary winding FT2*as* of feedback transformer FT2*a* is connected between the base and the emitter of transistor Q2*a;* and secondary winding FT2*bs* of feedback transformer FT2*b* is connected between the base and the emitter of transistor Q2*b*.

A resistor R1 is connected between the B+ bus and a junction DJ1; and a capacitor C1 is connected between junction DJ1 and the B− bus. A Diac D1 is connected between junction DJ1 and the base of transistor Q1*b*.

A series-combination of a normally-open thermally-activated switch NOTAS and a resistor R2 is connected between the B+ bus and a junction DJ2. This switch also has two auxiliary terminals AT1 and AT2 connected directly between the B+ bus and the B− bus. A capacitor C2 is connected between junction DJ2 and the B− bus. A Diac D2 is connected between junction DJ2 and the base of transistor Q2*b*.

A control transistor Q*c* is connected with its collector to junction DJ2 and its emitter to the B− bus. A series-combination of a resistor R3 and a Diac D3 is connected between a junction DJ3 and the base of transistor Q*c*. A capacitor C3 is connected between junction DJ3 and the B− bus. A resistor R4 is connected between junction DJ3 and first control input terminal CIT1. A resistor R5 is connected between first control input terminal CIT1 and a second control input terminal CIT2; which second control input terminal is connected with the B− bus.

Primary winding T1*p* of a transformer T1 is connected between inverter output terminals OT1*x* and OT1*y*. Secondary winding T1*s* is connected between cathode power output terminals CPOT1 and CPOT2.

Primary winding T2*p* of a transformer T2 is connected between inverter output terminals OT2*x* and OT2*y*. Secondary winding T2*s* is connected between terminal OT2*y* and a main power output terminal MPOT2. A main power output terminal MPOT1 is connected directly with inverter output terminal OT2*x*.

A first set of central terminals CT1 has two individual central terminals CT1*a* and CT1*b*; which terminals are connected with terminals CPOT1 and CPOT2, respectively.

A second set of central terminals CT2 has five individual central terminals CT2*a*, CT2*b*, CT2*c*, CT2*d* and CT2*e*. Of these terminals, CT2*a* and CT2*b* are connected with CPOT1 and CPOT2 respectively; CT2*b* and CT2*c* are connected with MPOT1 and MPOT2, respectively; and CT2*d* and CT2*e* are connected with CIT1 and CIT2, respectively.

The assembly consisting of transistors Q1*a* and Q1*b*, feedback transformers FT1*a* and FT1*b*, and output terminals OT1*x* and OT1*y* is referred to as low power inverter LPI. The assembly consisting of transistors Q2*a* and Q2*b*, feedback transformers FT2*a* and FT2*b*, and output terminals OT2*x* and OT2*y* is referred to as high power inverter HPI. The overall power supply of FIG. 1 is referred to as central power supply CPS.

Figure 2:
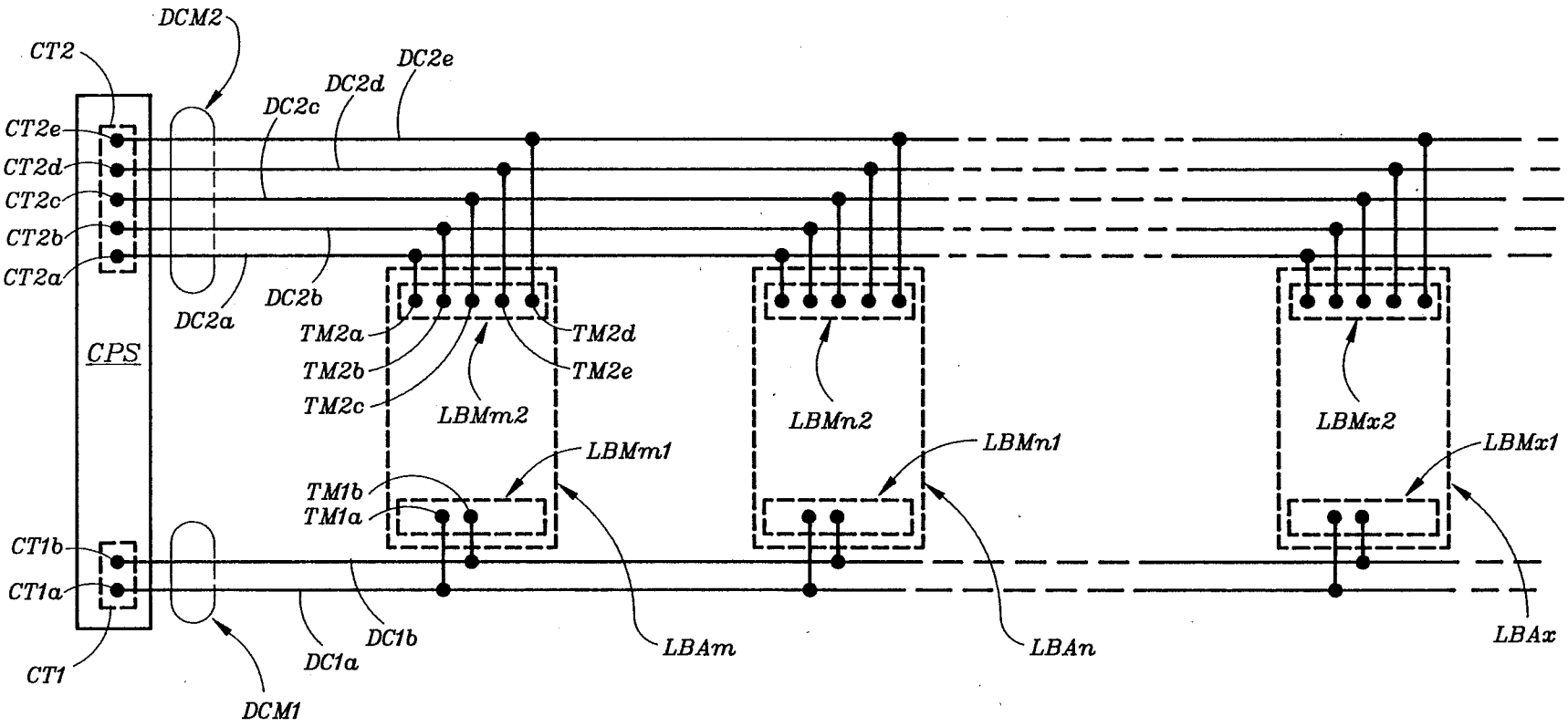
FIG. 2 diagrammatically describes the overall operating system in its preferred embodiment, including the central power supply, two sets of distribution conductors coming therefrom, and plural lamp-ballast assemblies connected between these two sets of distribution conductors.

FIG. 2 shows a first and a second set of distribution conductor means DCM1 and DCM2 connected respectively with the first and the second set of central terminals CT1 and CT2 on central power supply CPS.

The first set of distribution conductor means comprises two individual distribution conductors DC1*a* and DC1*b*; which are connected with central terminals CT1*a* and CT1*b*, respectively.

The second set of distribution conductor means comprises five individual distribution conductors DC2*a*, DC2*b*, DC2*c*, DC2*d* and DC2*e*; which are connected with central terminals CT2*a*, CT2*b*, CT2*c*, CT2*d* and CT2*e*, respectively.

Located between and connected with the two distribution conductor means DCM1 and DCM2, are a plurality of lamp-ballast assemblies LBAm, LBAn—LBAx. Each lamp-ballast assembly comprises two lamp-ballast matching means: LBMm1 and LBMm2, LBMn1 and LBMn2—LBM×1 and LBM×2, respectively.

Lamp-ballast matching means LBMm1 has two terminals Tm1*a* and Tm1*b*; which are connected to distribution conductors DC1*a* and DC1*b*, respectively. Lamp-ballast matching means LBMm2 has five individual terminals Tm2*a*, Tm2*b*, Tm2*c*, Tm2*d* and Tm2*e*; which are connected to distribution conductors DC2*a*, DC2*b*, DC2*c*, DC2*d* and DC2*e*, respectively.

Similarly, lamp-ballast matching means LBMn1 has two terminals, lamp-ballast matching means LBMn2 has five terminals, lamp-ballast matching means LBM×1 has two terminals, and lampballast matching means LBM×2 has five terminals; which terminals are all connected to individual distribution conductors in a manner that is analogous to the manner in which the terminals of lamp-ballast matching means LBNm1 and LBMm2 are connected.

Figure 3:
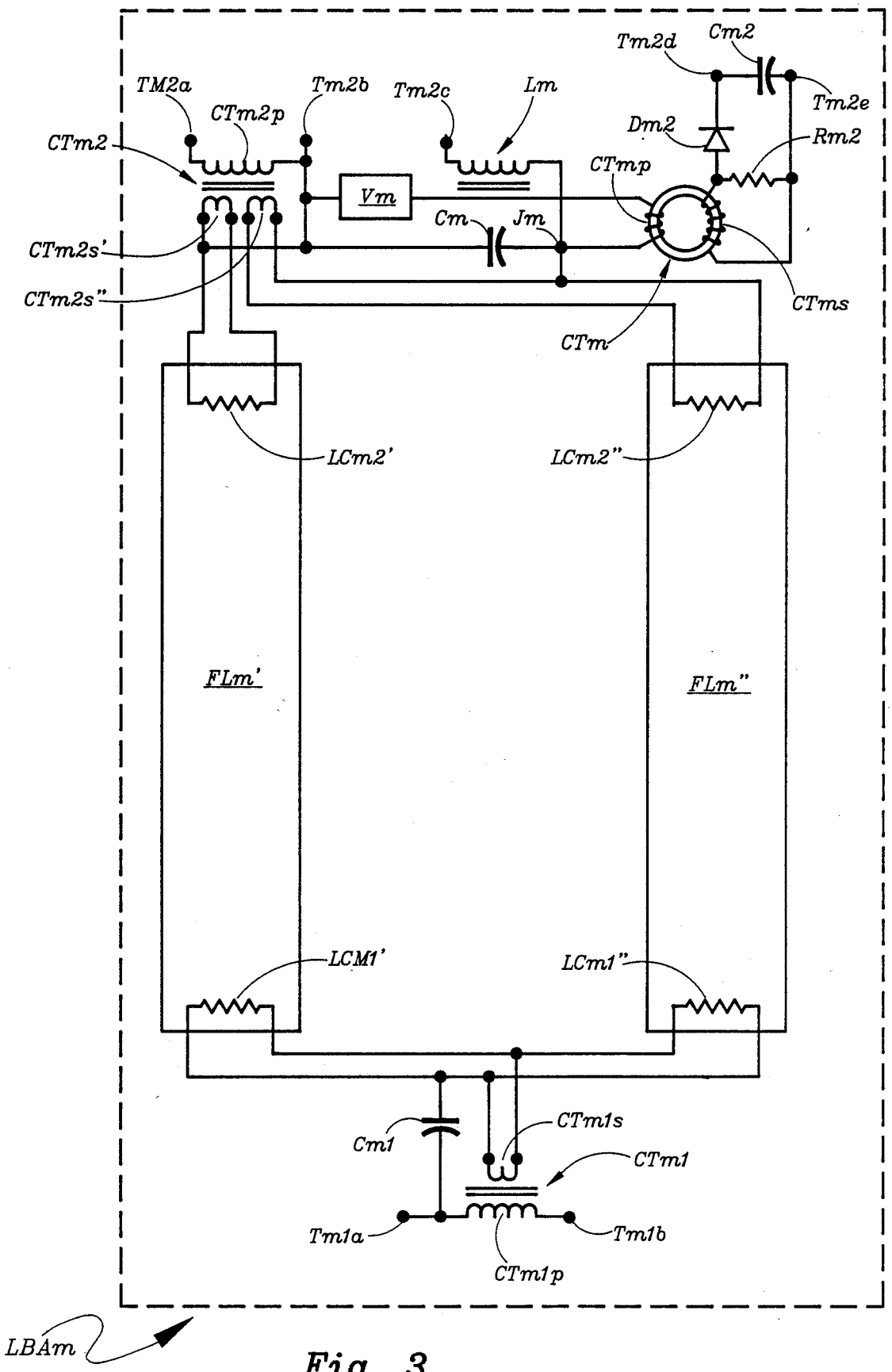
FIG. 3 provides schematic details of a lamp-ballast assembly.

FIG. 3 illustrates electric circuit details of lamp-ballast assembly LBAm.

A cathode transformer CTm1 has a primary winding CTm1*p* connected between terminals Tm1*a* and Tm1*b*; and it has a secondary winding CTm1*s* connected with the parallel-connected lamp cathodes LCm1′ and LCm1″ of fluorescent lamps FLm′ and FLm″, respectively.

A capacitor Cm1 is connected between terminal Tm1*a* and one of the terminals of secondary winding CTm1*s*.

A cathode transformer CTm2 has a primary winding CTm2*p* connected between terminals Tm2*a* and Tm2*b*; and it has two secondary winding CTm2*s*′and CTm2*s*″connected with lamp cathodes LCm2′ and LCm2″ of fluorescent lamps FLm′ and FLm″, respectively.

An inductor Lm is connected between terminal Tm2*c* and a junction Jm; and a capacitor Cm is connected between junction Jm and terminal Tm2*b*. Also connected with terminal Tm2*b* is one of the terminals of lamp cathode LCm2′. A series-combination of a Varistor Vm and primary winding CTmp of a current transformer CTm is connected between terminal Tm2*b* and junction Jm. Secondary winding CTms of transformer CTm is connected between terminal Tm2*e* and the anode of a diode Dm2. The cathode of diode Dm2 is connected with terminal Tm2d.

DETAILS OF OPERATION

The operation of the central power supply CPS of FIG. 1 may be explained as follows.

FIG. 1 shows two half-bridge inverters: a low power inverter LPI consisting of transistors Q1*a* and Q1*b* with their respective saturable positive feedback transformers FT1*a* and FT1*b*; and a high power inverter HPI consisting of transistors Q2*a* and Q2*b* with their respective saturable positive feedback transformers FT2*a* and FT2*b*.

Both inverters are capable of self-oscillation by way of positive feedback. When they do oscillate, the frequency of oscillation is about 30 kHz. For further explanation of the operation of this type of inverter, reference is made to U.S. Pat. Nos. 4,184,128 and 4,506,318, both issued to Nilssen.

Each of these inverters has to be triggered into oscillation; but they will only oscillate as long as the magnitude of the voltage between the B− bus and the B+ bus exceeds about 20 Volt. Thus, if one of the inverters is triggered into oscillation at the beginning of one of the sinusoidally-shaped DC voltage pulses existing between the B− bus and the B+ bus (as resulting from the unfiltered full-wave rectification of the voltage from the ordinary 120 Volt/60 Hz power line), that inverter will cease oscillating at the end of that DC voltage pulse. Thus, to keep either one of the inverters operating on a continuous basis, it is necessary that it be re-triggered at a rate of 120 times per second—i.e., once in the beginning of each half-cycle of the full-wave-rectified 120 Volt/60 Hz power line voltage.

Both the half-bridge inverters use capacitors C*a* and C*b* to provide for an effective center-tap between the B− bus and the B+ bus—this center-tap being junction JC.

When power line voltage is initially applied to the arrangement of FIG. 1, inverter LPI will immediately commence operation, receiving the requisite trigger pulses by way of trigger assembly R1/C1/D1. The time-constant associated with R1/C1 is such as to cause the voltage on C1 to reach a level high enough for Diac D1 to break down within about one millisecond after the beginning of each sinusoidally-shaped pulse provided by the full wave rectifier. Inverter HPI, on the other hand, will not start receiving trigger pulses—and therefore will not commence operation—until after the normally-open thermally-activated switch NOVAS has closed. In the preferred embodiment, the time required for this switch to close is about 1.5 second. Thereafter, however, inverter HPI starts receiving trigger pulses by way of trigger assembly R2/C2/D2. As with inverter LPI, the time-constant associated with R2/C2 is such as to cause the voltage on C2 to reach a level high enough for Diac D2 to break down within about one millisecond after the beginning of each sinusoidally-shaped pulse provided by the full wave rectifier.

Thus, the time required for capacitors C1 and C2 to be charged to Diac breakdown voltages is arranged to be but a small fraction of the length of a half-cycle of the 60 Hz power line voltage; which implies that both inverters will be triggered into oscillation at the beginning of each of the 120 Hz DC pulses provided between the B− bus and the B+ bus.

As a result of the relatively short time-constants, repeated triggering will occur during each complete DC pulse. While most often such repeated triggering is of little consequence, it is sometimes desirable to avoid it altogether; which may be accomplished by adding a first diode between junction DJ1 and the collector of transistor Q1*b* and a second diode between junction DJ2 and the collector of transistor Q2*b*—in both cases with the anodes of the diodes being connected with the junctions.

By applying current to the base of control transistor Q*c*, the voltage on capacitor C2 can be prevented from rising to a level high enough to cause Diac D2 to break down, thereby removing the trigger signals from the base of transistor Q2*b*, which therefore prevents inverter HPI from being triggered into operation at the beginning of each of the 120 Hz DC voltage pulses provided between the B+ bus and the B− bus. Thus, the operation of inverter HPI can be controlled by way of a voltage applied to control input terminals CIT1 and CIT2. However, there is a time-constant involved: a voltage applied to terminals CIT1 and CIT2 will charge capacitor C3 by way of resistor R5. With the magnitude of the voltage applied between terminals CIT1 and CIT2 being about 40 Volts, it takes approximately 50 milli-second for capacitor C3 to reach a voltage high enough to cause Diac D3 to break down.

As soon as Diac D3 breaks down, base current is provided to control transistor Q*c*; which therefore starts conducting and thereby preventing capacitor C2 from charging up—thereby, in turn, preventing inverter HPI from being triggered. Even if the voltage between terminals CIT1 and CIT2 is then immediately removed, current will continue to flow into the base of Q*c* for some period of time. The length of this period is determined by the capacitance value of capacitor C3 as combined with the effective resistance value of R3 in series with D3. In the preferred embodiment, the length of this time period is approximately 30 seconds. After this time period, the conduction of Diac D3 ceases and base current is removed from Q*c*, thereby again permitting inverter HPI to be triggered by its triggering circuit R2/C2/D2.

The purpose of resistor R5 is that of providing a means for discharging capacitor C3 over a relatively long time period—such as several minutes. Its presence has only a minor effect on the 30 seconds time-constant associated with C3/D3/R3.

Thus, if a DC voltage of about 40 Volt is applied to terminals CIT1/CIT2 for a period of 50 milli-seconds or so, the high-power inverter becomes disabled; and it then remains disabled for a period of about 30 seconds. Thereafter, it resumes normal operation, which will last until a DC voltage of about 40 Volt is again provided to the CIT1/CIT2 terminals for some 50 milli-seconds.

In normal operation, both inverters will provide a relatively high-frequency (30 kHz) squarewave AC voltage 100% amplitude-modulated at a frequency of 120 Hz.

By way of transformer T1, the output from low-power inverter LPI is apilied between central terminals CT1*a*/CT1*b*, as well as between central terminals CT2*a*/CT2*b*. By way of auto-transformer T2, the output from high-power inverter HPI is applied between central terminals CT2*b*/CT2*c*. Thus, central terminal CT2*b* acts as a common conductor for the output from both inverters.

With reference to FIG. 2, it is seen that central terminals CT1*a*/CT1*b* (CT1) and CT2*a*/CT2*b*/CT2*c*/CT2*d*/CT2*e* (CT2) are connected with distribution conductor means DCM1 and DCM2, respectively; and, by way of these distribution conductor means, each and every one of the plurality of lamp-ballast assemblies is connected with these central terminals.

With reference to FIG. 3, it is noted that—by way of an isolating voltage transformer (ex: CTm1)—the voltage provided from central terminals CT1*a*/CT1*b* is used for heating two of the cathodes of the two fluorescent lamps in each lamp-ballast assembly.

Also, by way of a small capacitor (ex: Cm1), the voltage from central terminal CT1*a* is applied to the two connected cathodes (ex: LCm1′/LCm1″)—the purpose being that of aiding in the starting of the fluorescent lamps. (Since the frequency of inverter LPI is not exactly the same as that of inverter HPI, the phasing of the squarewave voltage across central terminals CT1*a* and CT1*b* varies in relationship to that of the squarewave voltage across central terminals CT2*b* and CT2*c*; which implies that, at least during part of the time, the voltage provided by distribution conductor means DCM1 adds to the voltage provided by distribution conductor means DCM2—as far as lamp starting voltage is concerned.)

By way of another isolating voltage transformer (ex: CTm2), the voltage provided from central terminals CT2*a*/CT2*b* is used for heating the other two cathodes (ex: LCm2′/LCm2″) of the two fluorescent lamps in each lamp-ballast assembly.

Thus, the two lamps (ex: FLm′/FLm″) in each lamp-ballast assembly are series-connected; and these series-connected lamps are connected in parallel with a capacitor (ex: Cm) to form a lamp-capacitor parallel-combination, which parallel-combination is connected in series with an inductor (ex: Lm) to form an overall series-tuned L-C circuit connected between those two of the lamp-ballast assembly's input terminals (ex: Tm2*b*/Tm2*c*) that are connected with central terminals CT2*b* and CT2*c*. Thus, this series-tuned L-C circuit being resonant at or near the fundamental frequency of the squarewave voltage provided between central terminals CT2*b* and CT2*c*, the overall arrangement provides for resonant ballasting wherein the resonant circuit is series-excited and parallel-loaded.

Both the capacitor and the inductor have relatively high Q-factors; which implies that there will be a substantial Q-multiplication effect. That is, absent any loading, the magnitude of the voltage developing across the capacitor will be larger by a factor of Q in comparison to the magnitude of the voltage applied to the series-resonant circuit. Since the net unloaded Q-factor of the L-C circuit in the preferred embodiment is over 100, the magnitude of the voltage developing across the capacitor—assuming linear operation and no breakdown—would reach 12,000 Volt with an input of 120 Volt.

However, the L-C circuit is loaded both by the two seriesconnected fluorescent lamps and the Varistor—the Varistor being in effect connected in parallel with the two series-connected lamps.

The clamping voltage of the Varistor is so chosen that—in the absence of the fluorescent lamps—the magnitude of the voltage developing across the capacitor is just right for proper rapid-starting of the two series-connected lamps.

With the Varistor chosen so as to clamp the voltage across the capacitor to a magnitude suitable for rapid-starting of the series-connected lamps, substantially no current will flow through the Varistor after the lamps have started. Moreover, the lamps will not start if the cathodes are non-incandescent.

Thus, when the lamps' cathodes are fully incandescent, the lamps will rapid-start in a matter of a few milli-seconds. However, due to the voltage-magnitude-limiting provided by the Varistor, with cold cathodes the lamps won't start at all.

If, in lamp-ballast assembly LBAm, for some reason the lamps should not start—perhaps because their cathodes had not yet reached incandescence, or perhaps because they were damaged, worn out, or otherwise inoperative, or perhaps because they were disconnected—Varistor Vm will conduct; and current will then flow through the primary winding of current transformer CTm. As a result, a 30 kHz voltage is developed across resistor Rm2; which voltage is rectified by diode Dm2, and the resulting unidirectional voltage is filtered by capacitor Cm2 and provided across terminals Tm2*d* and Tm2*e*, and thereby across central terminals CT2*d* and CT2*e*. The magnitude of this unidirectional voltage is about 40 Volt.

Operation of the Complete System

With reference to FIG. 1 and FIG. 3, the complete system of FIG. 2 operates as follows.

(a) Upon initial application of power from the power line, inverter LPI immediately commences operation, thereby immediately starting to provide heating power to all the cathodes of all the fluorescent lamps in all of the plural lamp-ballast assemblies. Thus, within about 1.5 second after this initial application of power, all the lamp cathodes are incandescent.

(b) About 1.5 second after initial application of power from the power line, inverter HPI commences operation, thereby providing operating power to all the fluorescent lamps. Since by now all the lamps have incandescent cathodes, lamp starting will take place within a few milli-seconds.

(c) During the few milli-seconds before the lamps start, the L-C series-resonant ballasting circuits are each loaded with a Varistor, thereby preventing destructive over-voltages. While the Varistors are acting as loads, a DC control voltage of about 40 Volt magnitude is provided between control input terminals CIT1/CIT2. This voltage disappears as soon as the last pair of lamps start; which, under normal circumstances, will be well within 50 milli-seconds.

(d) However, if—in one or more of the lamp-ballast assemblies—a pair of lamps should not start within about 50 milli-seconds, the 40 Volt DC voltage provided between control input terminals CIT1/CIT2 will cause inverter HPI to cease operation, thereby removing power from all the series-resonant L-C ballasting circuits.

(e) At this point it should be noted that a Varistor—although it can absorb a very large amount of power for a brief period of time—can only absorb a miniscule amount of power on an average basis: a large-capacity Varistor is typically rated at about 1 Watt average power, although it may have a rating of more than 100 Joule in terms of energy-absorbing capacity. Thus, in subject system, a Varistor will indeed be able for 50 milli-second or so to safely absorb the approximately 400 Watt or power dissipation it is subjected to in case a pair of lamps fails to start—thereby absorbing a total amount of energy of about 20 Joule. However, within a maximum average power dissipation of 1 Watt, it would not be able to absorb such an amount of energy more often than once every 20 seconds.

(f) Due to the resonant nature of the ballasting circuits, the current flowing into each lamp-ballast combination will be substantially sinusoidal in waveshape even though the driving voltage is a squarewave.

(g) The fundamental nature of a high-Q resonant series-excited L-C circuit that is parallel-loaded with a gas discharge lamp, is one of providing this lamp with current from the near-equivalent of an ideal current source, with the magnitude of the current provided to the lamp being roughly proportional to the magnitude of the driving voltage, and the magnitude of the power being provided to the lamp being roughly proportional to the magnitude of the voltage present across the lamp.

As an overall result, the RMS magnitude of the current drawn from central power supply CPS by the plurality of lamp-ballast assemblies will be roughly proportional to the RMS magnitude of the squarewave voltage provided by this central power supply; which, since this squarewave voltage is amplitude-modulated in direct proportion to the instantaneous magnitude of the DC voltage provided from the full wave rectifier, implies that the magnitude of the instantaneous current drawn by the central power supply from the power line will be roughly proportional to the instantaneous magnitude of the voltage provided therefrom. Thus, the power factor by which the central power supply draws power from the power line will be high—approaching 100%.

(h) The amount of power that has to be provided by the low-power inverter LPI is less than 10% of the amount of power that has to be provided by high-power inverter HPI.

(i) The fluorescent lamps are started in a particularly gentle rapid-start fashion: the cathodes are allowed to reach full incandescence before lamp operating voltage is applied; and lamp starting aid is provided both by way of a starting capacitor (ex: Cm1 in FIG. 3) and by way of providing a ground-plane next to each lamp. (The ground-plane is not shown, but is indeed present by way of a grounded reflector means mounted directly behind all the lamps.)

(j) For extra high power levels, it would be advantageous to use a full-bridge arrangement (instead of the half-bridge arrangement shown) for high-power inverter HPI. That way, 30 kHz/120 Volt would be provided directly from the inverter—without any need for using a voltage transformer at the output.

(k) Because the lamp supply voltage is removed within a few milli-seconds if a fluorescent lamp is disconnected from the circuit, the lamp-ballast arrangement of FIG. 3 exhibits a high degree of safety from electric shock hazard.

Additional Comments

Otherwise, the following points should be noted.

(l) Capacitors Ca and Cb of FIG. 1 are sized such as not to store a significant amount of energy in comparison to the amount of energy drawn by the central power supply during one complete half-cycle of the 120 Volt/60Hz power line voltage, while at the same time to store an amount of energy that is several times as large as the amount of energy used by the inverters during one half-cycle of the 30 kHz inverter output voltage.

(m) Extra high operating efficiency can be achieved by removing the externally supplied cathode heating power once the lamps have started. This may be simply accomplished by disabling low-power inverter LPI as soon as high-power inverter HPI commences operation.

(n) The power supplied to the fluorescent lamps depends on the timing or phasing of the trigger pulses provided to highpower inverter HPI. In turn, the timing of these trigger pulses depend on the delay associated with the process of charging capacitor C2 to a voltage high enough to cause breakdown of Diac D2. The length of this delay can be adjusted over a wide range by adjusting the resistance value of R2.

(o) Instead of using two separate inverters (ex: LPI and HPI), a single inverter may be used—with switch means operable to provide the requisite delay in applying the 30 kHz/120 Volt operating power to the lamps.

(p) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. In a sun tanning apparatus adapted to be powered from an ordinary electric utility power line, the improvement comprising:

central power supply connectable with said power line and operable to provide a first central output of a first AC voltage and a second central output of a second AC voltage, said power supply having central control input terminals and being operative to reduce the magnitude of said second AC voltage after having received at said central control input terminals a control signal for longer than a certain period of time;

a plurality of lamp-ballast assemblies, each such assembly having: (i) a fluorescent tanning lamp means having thermionic cathodes, each cathode having a pair of cathode input terminals, said lamp means having a pair of lamp input terminals and requiring thereacross a voltage of a first magnitude for proper starting and a voltage of a second magnitude for proper operation of said lamp means, said second magnitude being substantially lower than said first magnitude, (ii) first input terminal means connected in circuit with said pairs of cathode input terminals by way of isolating transformer means, (iii) second input terminal means connected with an L-C series-circuit having an inductor means and a capacitor means and being series-resonant at or near the frequency of said second AC voltage, said lamp input terminals being effectively connected in parallel with said capacitor means,(iv) voltage-clamping means effectively connected in parallel with said capacitor means and operative to cause clamping of the voltage developing thereacross so as to prevent its magnitude from substantially exceeding said first magnitude, and (v) sensing means connected with the voltage-clamping means and operative to provide said control signal at a pair of control output terminals whenever said voltage-clamping means acts to cause said clamping; and distribution conductor means operative, for each lamp-ballast assembly, to connect: (i) said first central output with said first input terminal means, (ii) said second central output with said second input terminal means, and (iii) said central control input terminals with said control output terminals;

whereby the central power supply is operative to: (i) provide cathode heating power to said cathodes, (ii) provide lamp operating power to said lamp means, and (iii) reduce the magnitude of said second AC voltage if in any one of the plurality of lamp-ballast assemblies said clamping occurs for longer than said certain period of time.

2. The improvement of claim 1 wherein the fundamental frequency of said second AC voltage is substantially higher that that of the voltage provided by said power line.

3. The improvement of claim 1 wherein the length of said certain period of time is on the order of 50 milliseconds.

4. The improvement of claim 1 wherein, upon initially connecting the central power supply with the power line, said first AC voltage is provided at said first central output substantially without delay, whereas said second AC voltage is provided at said second output after a pre-determined delay.

5. The improvement of claim 4 wherein the length of said pre-determined delay is on the order of one second, thereby providing for sufficient time for the cathodes to reach incandescence before applying lamp operating power to the lamp means.

6. The improvement of claim 1 wherein each of said lamp-ballast assemblies comprises:

an elongated and substantially straight fluorescent tanning lamp having a first end with a thermionic cathode and a second end with a thermionic cathode;

a first set of electrical terminals located substantially adjacent said first end; and a second set of electrical terminals located substantially adjacent said second end.

7. The improvement of claim 6 wherein said distribution conductor means comprises a first and a second set of conductors, and wherein, for each lamp-ballast assembly, said first set of conductors are connected with said first set of electrical terminals and said second set of conductors are connected with said second set of electrical terminals.

8. The improvement of claim 1 wherein said lamp means comprises two series-connected fluorescent tanning lamps.

9. The improvement of claim 1 wherein said second AC voltage is an amplitude-modulated squarewave voltage.

10. The improvement of claim 1 wherein the starting of said lamp means occurs within a period of about 50 milli-seconds once its cathodes have become incandescent.

11. An operating system for a sun tanning apparatus, said operating system being adapted to be powered from an ordinary electric utility power line and comprising:

central power supply connectable with said power line and having a first and a second set of central output terminals, said central power supply being operable to provide a first and a second substantially non-current-limited AC voltage, said first and second AC voltage both being provided at said first set of central output terminals, said second AC voltage being provided at said second set of central output terminals;

a plurality of lamp-ballast assemblies, each such assembly having: (i) an elongated fluorescent lamp means having a first set of lamp input terminals and a second set of lamp input terminals, said first set of lamp input terminals being located at the opposite end of the lamp means as compared with said second set of lamp input terminals, said lamp means having first and second thermionic cathode means respectively located adjacent to and connected with said first and second set of lamp input terminals, said lamp means also having a pair of main lamp power input terminals located adjacent to and connected with said first set of lamp input terminals, (ii) a first set of assembly terminals located substantially adjacent said first set of lamp input terminals, (iii) a second set of assembly terminals located substantially adjacent said second set of lamp input terminals, (iv) transformer means connected in circuit between said first set of assembly terminals and said first set of lamp input terminals, (v) L-C circuit series-connected across two main assembly power input terminals of said first set of assembly terminals and connected in circuit with said pair of main lamp power input terminals, said L-C circuit being resonant at or near the frequency of said first AC voltage and operable to provide ballasted AC voltage to said lamp means whenever said first AC voltage is provided between said two main assembly power input terminals, and (vi) transformer means connected in circuit between said second set of assembly terminals and said second set of lamp input terminals; and distribution conductor means operative, for each lamp-ballast assembly, to connect: (i) said first set of central output terminals with said first set of assembly terminal, and (ii) said second set of central output terminals with said second set of assembly terminals;

thereby to provide heating power for said thermionic cathodes from said first AC voltage and operating power for said lamp means from said second AC voltage.

12. The operating system of claim 11 wherein said lamp means comprises two series-connected fluorescent lamps.

13. The improvement of claim 11 wherein said first AC voltage has a fundamental frequency that is substantially higher than the frequency of the voltage on said power line and wherein said central power supply comprises:

rectifier means connected with the power line and operative to provide a DC voltage;

first inverter means connected with said DC voltage and operative to provide said first AC voltage; and second inverter means connected with said DC voltage and operative to provide said second AC voltage.

14. The improvement of claim 13 and starting capacitor means connected between said second set of assembly terminals and said second set of lamp input terminals.

15. The improvement of claim 11 wherein said L-C circuit has an inductor means and a capacitor means, and wherein said lamp means is effectively connected in parallel with said capacitor means.

16. The improvement of claim 15 and voltage-clamping means effectively connected in parallel with said capacitor means, thereby to protect said L-C circuit from over-voltage conditions in the event said fluorescent lamp means were to be inoperative or removed during any period while said first AC voltage was being provided between said two main assembly power input terminals.

17. The operating system of claim 11 and means whereby, when said central power supply is initially connected with said power line, said second AC voltage is provided in immediate response thereto, whereas said first AC voltage is not provided until a brief period thereafter.

18. The operating system of claim 17 wherein the duration of said brief period is on the order of one second, thereby providing time for said thermionic cathodes to become fully incandescent before said first AC voltage is applied across said L-C circuit.

19. The operating system of claim 11 wherein a ground plane is positioned adjacent said fluorescent lamp means.

20. An operating system for a sun tanning apparatus, said operating system being adapted to be powered from an ordinary electric utility power line and comprising:

central power supply connectable with said power line and operable to provide a first and a second non-current-limited AC voltage at a set of central output terminals;

a plurality of lamp-ballast assemblies, each such assembly having: (i) a fluorescent lamp means having a set of lamp input terminals and thermionic cathode means connected with said lamp input terminals, said lamp means also having a pair of main lamp power input terminals connected with said lamp input terminals, (ii) a set of assembly terminals, (iii) transformer means connected in circuit between said assembly terminals and said lamp input terminals, (iv) L-C circuit series-connected across two main assembly power input terminals of said set of assembly terminals and connected in circuit with said pair of main lamp power input terminals, said L-C circuit being resonant at or near the frequency of said first AC voltage and operable to provide ballasted AC voltage to said lamp means whenever said first AC voltage is provided between said two main assembly power input terminals; and distribution conductor means operative to connect said set of central output terminals with the assembly terminals of each lamp assembly;

whereby operating power is provided from said first AC voltage to said lamp means by way of said pair of main lamp power input terminals, and heating power is provided from said second AC voltage to said thermionic cathodes by way of said lamp input terminals.

21. The operating system of claim 20 and means whereby, when said central power supply is initially connected with said power line, said second AC voltage is proved in immediate response thereto, whereas said first AC voltage is not provided until a brief period thereafter.

22. The operating system of claim 20 wherein said transformer means is an entity separate and distinct from any part of said L-C circuit.

23. The operating system of claim 20 wherein said first AC voltage is a squarewave voltage but wherein the current flowing in response to this squarewave voltage is substantially sinusoidal in waveshape.

* * * * *